United States Patent [19]

Matsui et al.

[11] Patent Number: 4,996,182

[45] Date of Patent: Feb. 26, 1991

[54] HEAT-SENSITIVE RECORDING MATERIAL

[75] Inventors: Takeshi Matsui; Takehiko Watanabe, both of Osaka; Katsunori Miyazaki, Inuyamaa; Hiroo Hayashi, Takatsuki, all of Japan

[73] Assignee: Toyo Boseki Kabushiki Kaisha, Osaka, Japan

[21] Appl. No.: 312,916

[22] Filed: Feb. 21, 1989

[30] Foreign Application Priority Data

Jun. 8, 1988 [JP] Japan ..... 63-140911

[51] Int. Cl.[5] ..... B41M 5/18

[52] U.S. Cl. ..... 503/200; 427/152; 503/226

[58] Field of Search ..... 427/150–152; 428/319.9; 503/200, 226

[56] References Cited

FOREIGN PATENT DOCUMENTS 59-171685 9/1984 Japan .

59-225987 12/1984 Japan .

*Primary Examiner*—Pamela R. Schwartz

*Attorney, Agent, or Firm*—Cantor, Mueller & Player Wegner

[57] ABSTRACT

A heat-sensitive recording material which comprises a heat-sensitive recording layer and a substrate, the substrate having as a constituent element a synthetic resin film layer containing minute cavities and a content of cavities in the synthetic resin film layer being 40 to 100 cc/100 g. The heat-sensitive recording material has excellent resolution and gives a clear recorded image having a high density even with low printing energy.

5 Claims, 2 Drawing Sheets

HEAT-SENSITIVE RECORDING MATERIAL

FIELD OF THE INVENTION

The present invention relates to a heat-sensitive recording material such as a heat-sensitive recording paper or film which has excellent resolution and can give a clear recorded image in a high density.

BACKGROUND OF THE INVENTION

As heat-sensitive recording material, there has been known a material having a heat-sensitive layer on a substrate such as paper. In the heat sensitive layer, a color former and a color developer which produces color when it contacts with the color former, and a colored image can be obtained by heating with, what is called, a heating pen or thermal head.

Such a heat-sensitive recording material is relatively cheap and is used as a recording medium in various fields such as facsimile, various calculators, medical instruments, computers, heat-sensitive copying machines and printers of other various instruments and apparatus.

However, since development of various office machines and diversification of their use progress rapidly, it is desirable to develop a new heat-sensitive recording material which can meet respective requirements. For example, in order to meet requirements for making the operating speed of recording apparatuses fast, a recording material which can provide a clear image having a high density even with very low printing energy is desired. For this purpose, it has been recognized that not only a heat-sensitive layer itself but also its substrate should be studied and, thereby, use of synthetic paper or synthetic resin film instead of conventional natural paper have been increased.

As means to cope with low printing energy due to high-speed printing, for example, a heat-sensitive recording material disclosed in Japanese Patent Kokai No. 59-171685 has an undercoat layer containing minute cells and having excellent elasticity and heat insulating properties which is formed by providing a layer composed of a thermal expanding agent and a thermoplastic polymer on a substrate and heating the layer. In this heat-sensitive recording material, a clear recorded image having a relatively high density can be obtained even with low printing energy because of formation of the undercoat layer having elasticity and heat insulating properties. However, for producing the recording material, a step for expanding the thermal expanding agent is required. In addition, it is very difficult to control the degree of expansion in this step, and a uniformly expanded layer can hardly obtained. Therefore, there is a defect in reproducibility of fine and thin images such as that required in, for example, a video printer. On the other hand, Japanese Patent Kokai No. 59-225987 discloses a method for improving evenness by providing a pigment coating layer on an expanded layer. However, since minute uneveness still remains on the recording layer, it is difficult to obtain a heat-sensitive recording material having sufficient resolution.

OBJECTS OF THE INVENTION

The main object of the present invention is to provide a heat-sensitive recording material such as a heat-sensitive recording paper or film which has excellent resolution and can give a clear recorded image having a high density even with low printing energy.

This object as well as other objects and advantages of the present invention will become apparent to those skilled in the art from the following description with reference to the attached drawings.

BRIEF EXPLANATION OF DRAWINGS

FIG. 3 is an electron micrograph illustrating the cross sectional structure of the film No. 3 obtained in Example 1 hereinafter.

SUMMARY OF THE INVENTION

Figure 1:
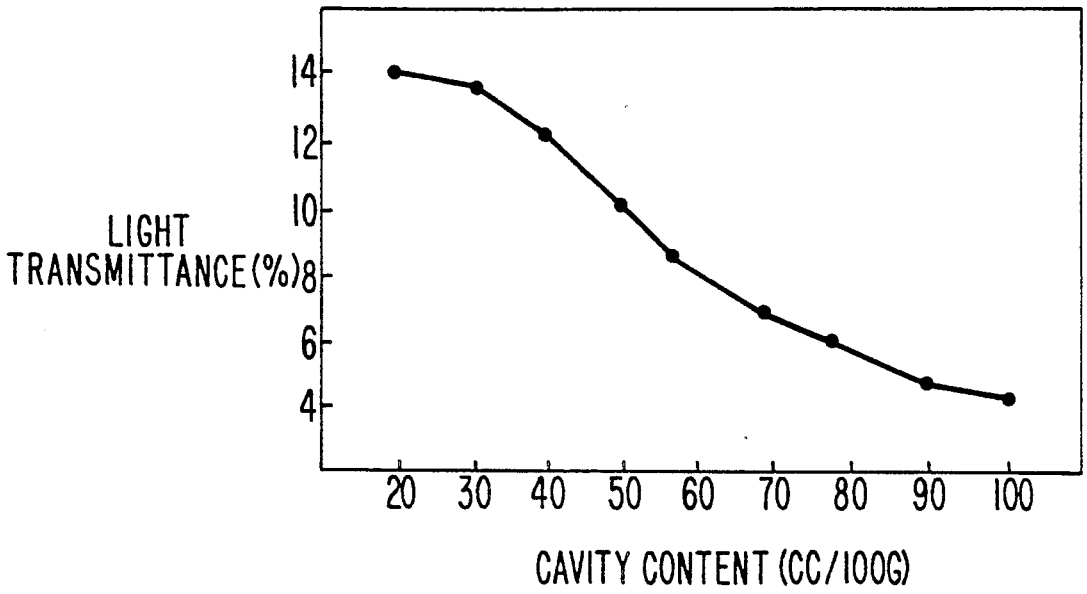
FIG. 1 is a graph illustrating the relation between a content of cavities (cc/100 g) and transmittance (%) of the film containing cavities obtained in Example 1 hereinafter.

According to the present invention, there is provided a heat-sensitive recording material which comprises a heat-sensitive recording layer and a substrate, said substrate having as a constituent element a synthetic resin film layer containing minute cavities and a content of cavities in said synthetic resin film layer being 40 to 100 cc/100 g. Particularly, when the synthetic resin film layer is composed of a mixture of a polyolefin and a substance immiscible with the polyolefin and is biaxially oriented, the resulting heat-sensitive recording material has especially excellent resolution. Further, when the synthetic resin film layer is laminated with a film layer made of a material which is the same as or different from that of the synthetic resin film layer, stiffness of the substrate can be controlled.

DETAILED DESCRIPTION OF THE INVENTION

In order to obtain a heat-sensitive recording material which can obtain a clear image having a high density even with low printing energy, the present inventors have studied intensively. As the result, it has been found that, when a synthetic resin film layer containing minute cavities is provided as a constituent element of a substrate of a heat-sensitive recording material, a clear image having a high density can be obtained even if picture quality is fine and thin. This results from heat insulating and cushioning properties of the synthetic resin film layer containing minute cavities which is provided under a heat-sensitive recording layer of the recording material.

The content of cavities in the synthetic resin film layer should be 40 to 100 cc/100 g. When the content of cavities is less than 40 cc/100 g, heat insulating and cushioning properties of the film become low and, thereby, a good image can be hardly obtained and opacity becomes inferior. On the other hand, the content of cavities is greater, heat insulating and cushioning properties of the film are better and, thereby, a better image can be obtained and opacity becomes better. However, when the content exceeds 100 cc/100 g, stiffness of the film becomes inferior.

The synthetic resin film having minutes cavities used in the present invention can be produced as follows:

A synthetic resin and a substance which is immiscible in the resin are mixed, melted and extruded to obtain a non-oriented film. When the film is biaxially oriented successively, cavities are formed toward the orientation direction due to the function of the immiscible substance as nuclei. In this case, when the draw ratio is higher and the orienting temperature is lower, more cavities are formed. Therefore, the content of cavities can be controlled by adjusting the draw ratio and the orienting temperature to obtain the desired content as described above.

As the synthetic resin, there can be used general-purpose synthetic resins such as polyolefins, polyamides, polyesters, polyvinyl chloride and the like. However, in view of suitable cushioning properties, easy film formation, stability against humidity and no generation of chlorine upon burning as well as from the economical viewpoint, polyolefins are preferred. As polyolefins, there can be used polyethylene, polypropylene, their copolymers, a mixture thereof and the like.

As the substance immiscible with the synthetic resin, there can be used inorganic substances or polymers which are immiscible with the above synthetic resins. In order to facilitate formation of minute cavities, inorganic substances are preferred. Examples of the inorganic substances include calcium carbonate, calcium oxide, silica, titanium oxide, alumina, aluminum sulfate and the like. Particularly, calcium carbonate is preferred. The particle size of the inorganic substance is preferably 0.1 to 15 μm, more preferably 0.5 to 10 μm. When the particle size is less than 0.1 μm, cavities are scarcely formed extending over the surface and inner part of the oriented film. When the particle size exceeds 15 μm, stretchability upon film formation becomes inferior. The amount of the inorganic substance to be admixed with the synthetic resin is preferably 5 to 50% by weight, more preferably 10 to 30% by weight based on the total weight of the resin and the inorganic substance. When the amount is less than 5% by weight, cavities are scarcely formed in the oriented film and the content of cavities is too low. On the other hand, when the amount exceeds 50%, stretchability upon film formation becomes inferior. Other immiscible substances can be used under similar conditions to those for inorganic substances.

Further, upon production of the synthetic resin film, titanium oxide and the like can be added to adjust whiteness and opacity of the film. Furthermore, other additives, for example, stabilizers, antistatic agents, dyes, pigments and the like can be added in so far as the properties of the film is not impaired. Alternatively, an antistatic agent or the like can be coated on the synthetic resin film.

These synthetic resin films are disclosed in Japanese Patent Kokoku Nos. 54-31030, 54-31032, 54-31033 and 54-31034, which correspond to U.S. Pat. No. 3,773,608, as well as Japanese Patent Kokai Nos. 57-181829 and 58-220139.

In the heat-sensitive recording material of the present invention, usually, the synthetic resin film thus produced can be used as a substrate itself and a heat-sensitive recording layer can be directly provided on the synthetic resin film layer. However, in the case that adhesion between the heat-sensitive recording layer and the synthetic resin film layer is poor, a middle layer such as a suitable anchor coat layer or adhesive layer can be provided between the recording layer and the synthetic resin film layer. Further, in the case that stiffness of the synthetic resin film is insufficient, a core layer can be provided under the synthetic resin film layer.

These middle layers and core layers themselves are known in the art and are not specifically limited.

Preferably, the substrate has a layer of the synthetic resin film containing cavities of at least 4 μm in thickness. For example, in the case that the substrate is composed of only a layer of the synthetic resin film containing minute cavities, the substrate is preferably 30 to 300 μm in thickness. In the case that the substrate is a laminate of the synthetic resin film containing minute cavities and a film containing no cavity (core layer), the substrate is preferably 25 to 300 μm in thickness and has a layer of the synthetic resin film containing minute cavities of at least 4 μm in thickness.

Typical examples of the laminated structure of the heat-sensitive recording material of the present invention are as follows:

C/A/B and C/A/B/A wherein A is the synthetic resin film containing minute cavities, B is a film having no cavity (core layer) and C is the heat-sensitive recording layer.

Further, in the case that the synthetic resin film containing minute cavities is exposed to the back surface, a thin layer film can be provided on the surface of the synthetic resin film layer to prevent removal of the inorganic substance contained therein.

The heat-sensitive recording layer is provided on such a substrate composed of the synthetic resin film layer alone or in combination thereof with the middle layer and/or the core layer. The heat-sensitive recording layer is not specifically limited, either and there can be used any conventional heat-sensitive recording layer which contains a color producing agent and a color developing agent which can produce color by contacting with the color producing agent. For example, there can be used a combination of a colorless or pale colored basic dye and an inorganic or organic acidic substance, or a combination of a higher fatty acid metal salt such as ferric stearate and a phenol such as gallic acid. Further, it is possible to use a combination of a diazonium compound, a coupler and a basic substance.

As the above colorless or pale colored basic dye (color former), there can be used known dyes, for example, triarylmethane dyes such as 3,3-bis(p-dimethylaminophenyl)-6-dimethyl-aminophthalide, 3,3-bis(p-dimethylaminophenyl)-phthalide, 3-(p-dimethylamino-phenyl)-3-(1,2-dimethylindol-3-yl)-phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylaminophenyl-3-(1-methylpyrrol-3-yl)-6-dimethylamino-phthalide and the like; diphenylmethane dyes such as 4,4'-bis-dimethylaminobenzhydryl benzyl ether, N-halophenyl-leucoauramine, N-2,4,5-trichlorophenyl-leucoauramine and the like; thiazine dyes such as benzoylleucomethylene blue, p-nitrobenzoyl-leucomethylene blue and the like; spiro dyes such as 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)-spiropyran, 3-propyl-spiro-dibenzopyran and the like; lactum dyes such as rhodamine B anilinolactum, rhodamine(p-nitroanilino)lactum, rhodamine(o-chloroanilino)-lactum and the like; and fluorane dyes such as 3-dimethylamino-7-methoxyfluorane, 3-diethylamino-6-methoxyfluorane, 3-diethylamino-7-methoxyfluorane, 3-diethylamino-7-chlorofluorane, 3-diethylamino-6-methyl-7-chlorofluorane, 3-diethylamino-6,7-dimethylfluorane, 3-(N-ethyl-p-toluidino)-7-methylfluorane, 3-diethylamino-7-N-acetyl-N-methylaminofluorane, 3-diethylamino-7-N-methylaminofluorane, 3-diethylamino-7-dibenzylaminofluorane, 3-diethylamino-7-N-methyl-N-benzylaminofluorane, 3-diethylamino-7-N-chloroethyl-N-methylaminofluorane, 3-diethylamino-7-N-diethylaminofluorane, 3-(N-ethyl-p-toluidino)-6-methyl-7-phenylaminofluorane, 3-(N-cyclopentyl-N-ethylamino)-6-methyl-7-anilinofluorane, 3-(N-ethyl-p-toluidino)-6-methyl-7-(p-toluidino)fluorane, 3-diethylamino-6-methyl-7-phenylaminofluorane, 3-diethylamino-7-(2-carbomethoxyphenylamino)fluorane, 3-(N-ethyl-N-isoamylamino)-6-methyl-7-phenylamino-fluorane, 3-(N-cyclohexyl-N-methylamino)-6-methyl-7-phenylaminofluorane, 3-piperidino-6-methyl-7-phenylaminofluorane, 3-piperidino-6-methyl-7-phenylaminofluorane, 3-diethylamino-6-methyl-7-xylidinofluorane, 3-diethylamino-7-(o-chlorophenylamino)fluorane, 3-dibutylamino-7-(o-chlorophenylamino)fluorane, 3-pyrrolidino-6-methyl-7-p-butylphenylaminofluorane, 3-N-methyl-N-tetrahydrofurfurylamino-6- methyl-7-anilinofluorane, 3-N-ethyl-N-tetrahydrofurfurylamino-6-methyl-7-anilino-fluorane and the like.

As the acidic inorganic or organic substance (color developer) which can produce color by contacting with the basic dye, there can be used known acidic inorganic substances, for example, activated clay, acid clay, attapulgite, bentonite, colloidal silica, aluminum silicate and the like, and known organic acidic substances, for example, phenolic compounds such as 4-tert-butylphenol, 4-hydroxydiphenoxide, α-naphthol, β-naphthol, 4- hydroxyacetophenol, 4-tert-octylcatechol, 2,2'- dihydroxydiphenol, 2,2'-methylenebis(4-methyl-6-tertisobutylphenol), 4,4'-isopropylidenebis(2-tert-butylphenol), 4,4'-sec-butylidenediphenol, 4-phenylphenol, 4,4'-isopropylidenediphenol (bisphenol A), 2,2'-methylenebis(4-chlorophenol), hydroquinone, 4,4'-cyclohexylidenediphenol, benzyl 4-hydroxybenzoate, dimethyl 4-hydroxyphthalate, hydroquinonemonobenzyl ether, novolak phenolic resin, phenol polymers and the like; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)-salicylic acid, 3,5-di-α-methylbenzylsalicylic acid and the like; and salts of the above phenolic compounds and aromatic carboxylic acids with polyvalent metals such as zinc, magnesium, aluminum, calcium, titanium, manganese, tin, nickel and the like.

The above basic dyes (color formers) and color developers can be used alone or in combination thereof. The ratio of the basic dye and the color developer is not specifically limited and can be appropriately chosen according to particular dye and color developer to be used. Usually, the color developer can be used in an amount of 1 to 20 parts by weight, preferably 2 to 10 parts by weight per 1 part by weight of the basic dye.

A coating composition containing these substances is prepared by dispersing the dye (color former) and the color developer in a dispersion medium such as, in general, water simultaneously or separately with an agitator or grinder such as ball mill, attritor mill, sand mill or the like.

In the coating composition, a binder is added in an amount of about 2 to 40% by weight, preferably 5 to 25% by weight based on the total solids constituent of the composition. Examples of the binder include starches, hydroxyethyl cellulose, methyl cellulose, carboxymethylcellulose, gelatin, casein, gum arabic, polyvinyl alcohol, acetoacetyl modified polyvinyl alcohol, diisobutylene-maleic anhydride copolymer salt, styrene-maleic anhydride copolymer salts, ethylene-acrylic acid copolymer salts, styrene-butadiene copolymer emulsion, urea resin, melamine resin, amide resin, amino resin and the like.

Further, if necessary, various auxiliaries can be added to the coating composition. Examples of auxiliaries include dispersants such as sodium dioctylsulfosuccinate, sodium dodecylbenzenesulfonate, sodium lauryl sulfonate, metal salts of fatty acids and the like; antifoaming agents; fluorescent dyes; colorants; electrically conducting substances and the like.

Furthermore, if necessary, the coating composition can contain waxes such as zinc stearate, calcium stearate, polyethylene wax, carnauba wax, paraffin wax, ester wax and the like; fatty acid amides such as stearic acid amide, stearic acid methylene bis amide, oleic acid amide, palmitic acid amide, coconut fatty acid amide and the like; hindered phenols such as 2,2'-methylenebis(4-methyl-6-tert-butylphenol), 1,1,3-tris(2-methyl-4-hydroxy-5-tert-butylphenyl)butane and the like; ultraviolet absorbers such as 2-(2'- hydroxy-5'-methylphenyl)benzotriazole and the like; benzophenones such as 2-hydroxy-4-benzyl-oxybenzophenone and the like; esters such as 1,2-di(3-methylphenoxy)ethane, 1,2- diphenoxyethane, 1-phenoxy-2-(4-methylphenoxy)ethane, dimethyl terephthalate, dibutyl terephthalate, dibenzyl terephthalate, p-benzylbiphenyl, 1,4-dimethoxynaphthalene, 1,4-diethoxynaphthalene, phenyl 1-hydroxynaphthoate and the like; various known heat fusible substances; and inorganic pigments such as kaolin, clay, talc, calcium carbonate, calcined clay, titanium oxide, diatomaceous earth, finely divided anhydrous silica, activated clay and the like.

In the heat-sensitive recording material of the present invention, the formation of the heat-sensitive recording layer is not specifically limited and, for example, it is formed by coating the coating composition according to air-knife coating, blade coating or the like and then drying the resulting coat. Further, the coating weight is not specifically limited either and, usually, the layer is prepared in the dry weight range of about 2 to 12 $g/m^2$, preferably, about 3 to 10 $g/m^2$.

Optionally, on the surface of the heat-sensitive recording layer of the recording material, it is possible to provide an overcoat layer to protect the recording layer according to a know method. Further, there can be employed various known modifications in the field of heat-sensitive recording materials. For example, a pressure-sensitive adhesive layer can be provided on the back surface of the recording material to obtain a pressure-sensitive adhesive label.

The following Examples further illustrate the present invention in detail but are not to be construed to limit the scope thereof. In the Examples, all "parts" and "%'s" are by weight unless otherwise stated.

In the Examples, properties were determined as follows:

(1) Opacity

According to JIS K 6714, the total luminous transmittance of a sample was determined. The evaluation in the Examples were carried out according to the following criteria:

A: total luminous transmittance of less than 5%
B: total luminous transmittance of 5% to less than 9 %
C: total luminous transmittance of 9% to less than 15%
D: total luminous transmittance of more than 15%

A sample having a lower transmittance has better opacity.

(2) Apparent density

The apparent density was calculated by the weight of a unit volume of a sample according to the following equation:

$$\text{Apparent density} = \text{Weight}/\text{Volume}$$

wherein Volume is that of a sample of 10 cm×5 cm×cm in thickness ($cm^3$); and Weight is that of the sample of such a volume (g).

(3) Cavity content

Cavity content is corresponding to the volume of cavities in 100 g of a synthetic resin film and calculated by the following equation:

$$\text{Cavity content} = 100 \times \left( \frac{1}{D} - \frac{\Sigma Mi/\rho i}{100} \right)$$

wherein Mi is a mixing ratio (%) of each ingredient; $\rho i$ is a density of each ingredient; and D is the apparent density of an oriented film.

(4) Evaluation of recorded picture quality

A recorded image obtained by a commercially available video printer (UP-103 manufactured by Sony Corporation, Japan) was measured by Macbeth densitometer (RD-914 manufactured by Macbeth Company) and a part of the recorded image having a recorded density of about 0.6 was evaluated as follows:

The recorded part was divided into three areas of high density area, low density area and blank area by using a dot analyzer (DA-2000 manufactured by Kanzaki Paper Mfg. Co., Ltd., Japan). The ratio of the high density area was calculated and evaluated according to the following criteria:

A: high density area being more than 45%
B: high density area being 40% to less than 45%
C: high density area being 30% to less than 40%
D: high density area being 20% to less than 30%
E: high density area being less than 20%

The results are quite consistent with visual evaluation and a sample having a higher ratio of a high density area has better picture quality.

(5) Evaluation of stiffness

According to ASTM D882, Young's modulus ($kg/mm^2$) toward the machine direction (MD) and that toward the transverse direction (TD) were determined and stiffness was evaluated according to the following criteria:

A: MD of not less than 120 and TD of not less than 200
B: MD of 85 to less than 120 and TD of 150 to less than 200
C: MD of 50 to less than 85 and TD of 100 to less than 150
D: MD of less than 50 and TD of less than 100

A sample having higher MD and TD has better stiffness.

The coating composition for formation of the heat-sensitive recording layer by coating it on the substrate was prepared as follows:

Preparation of dispersion A

| Ingredients | Parts |
|---|---|
| 3-(N-ethyl-N-isoamylamino)-6-methyl-7-phenylaminofluorane | 10 |
| Dibenzyl terephthalate | 20 |
| 5% Aqueous solution of methyl cellulose | 20 |
| Water | 40 |

The ingredients were mixed and the mixture was ground with a sand mill until the average particle size reached 3 μm.

Preparation of dispersion B

| Ingredients | Parts |
|---|---|
| 4,4'-isopropylidene diphenol | 30 |
| 5% Aqueous solution of methyl cellulose | 40 |
| Water | 20 |

The ingredients were mixed and the mixture was ground with a sand mill until the average particle size reached 3 μm.

Preparation of coating composition

The above dispersions A (90 parts) and B (90 parts), silica pigment (Mizukasil P-527 manufactured by Mizusawa Kagaku K.K., Japan: average particle size: 1.8 μm : oil absorption: 180 cc/100 g) (30 parts), 10% aqueous polyvinyl alcohol solution (300 parts) and water (28 parts) were mixed and stirred to obtain the coating composition.

EXAMPLE 1

Figure 2:
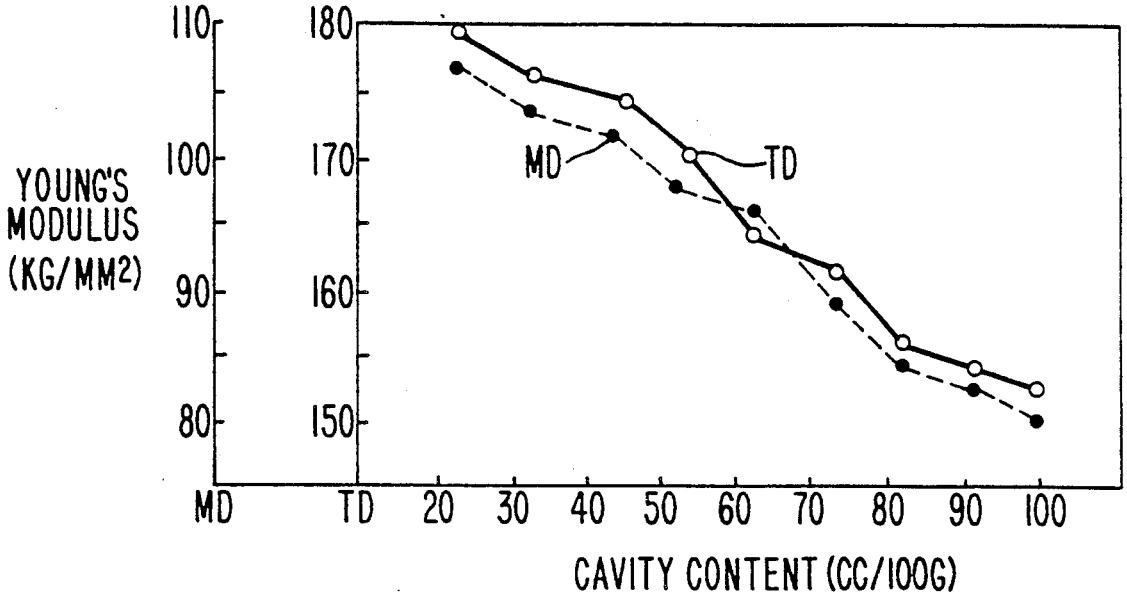
FIG. 2 is a graph illustrating the relation between a content of cavities (cc/100 g) and stiffness, i.e., Young's modulus (kg/mm$^2$) of the film containing cavities obtained in Example 1 hereinafter.

A mixture of polypropylene (MI=4) (70%), polyethylene (MI=0.5) (20%) and calcium carbonate (particle size: 5 μm) (10%) was subjected to melt extrusion at 270° C. After cooling, the extruded film was subjected to successive biaxial orientation to obtain a synthetic resin film having minute cavities of 100 μm in thickness. At this time, the orientation conditions were varied to obtain synthetic resin films having different contents of cavities. The relation between cavity content and luminous transmittance (opacity) of the resulting film is shown in the attached FIG. 1. The relation between cavity content and stiffness of the resulting film (Young's modulus) is shown in the attached FIG. 2.

A heat-sensitive recording material was obtained by coating an aqueous coating solution of a polyethylene imine anchoring agent and silica as an antiblocking agent on the synthetic resin film to provide an anchor coat layer, coating the above-prepared coating composition for the heatsensitive recording layer thereon so that the dry coating weight became 5 $g/m^2$, drying the layer and then supercalendering the resultant.

The properties of the resulting recording material are shown in Table 1. In Table 1, there are also shown the properties of a film obtained according to the same manner as described above except that paper or a polyester (PET) film is used as the substrate.

TABLE 1

| No. | 1 | 2 | 3 | 4 | 5 | 6 | 7 |
|---|---|---|---|---|---|---|---|
| Cavity content (cc/100 g) | 35 | 40 | 60 | 80 | 100 | paper | Milky PET 80 μm |

TABLE 1-continued

| No. | 1 | 2 | 3 | 4 | 5 | 6 | 7 |
|---|---|---|---|---|---|---|---|
| Picture quality | C | B | A | A | B | E | D |
| Opacity | C | B | B | A | A | A | B |
| Stiffness | A | B | B | C | C | A | A |

The cross sectional structure of the film No. 3 is shown in FIG. 3 which is an electron micrograph (scanning electron microscope, ×500).

EXAMPLE 2

A mixture of polypropylene (MI=4) (70%), polyethylene (MI=0.5) (20%) and calcium carbonate having particle size of 5 μm (10%) (for the film layer containing cavities), and a mixture of polypropylene (MI=4) (95%) and titanium oxide (5%) (for the core layer) were co-extruded at 280° C. to obtain a non-oriented three-layer film. Then, the film was subjected to orientation by adjusting the orienting temperature and the draw ratio in orientation toward the machine direction so that the cavity content of the cavity containing film layer in the final oriented film became 60 cc/100 g and then the film was oriented toward transverse direction to obtain the substrate of a heat-sensitive recording material.

Then, according to the same manner as described in Example 1, the coating composition for the heat-sensitive recording layer was coated on the substrate to obtain a heat-sensitive recording material having the above laminated structure of C/A/B/A (C: heat-sensitive reacording layer, A: layer of the synthetic resin film containing minute cavities, B: core layer).

The properties of the film are shown in Table 2. In Table 2, the properties of the above No. 3 in Table 1 (cavity content: 60 cc/100 g) are also disclosed.

TABLE 2

| No. | 8 | 9 | 10 | 11 | 3 |
|---|---|---|---|---|---|
| Thickness of C/A/B/A (μm) | 5/2/76/2 | 5/5/70/5 | 5/10/60/5 | 5/15/50/15 | no core |
| Picture quality | C | B | A | A | A |

TABLE 2-continued

| No. | 8 | 9 | 10 | 11 | 3 |
|---|---|---|---|---|---|
| Opacity | C | C | B | B | B |
| Stiffness | A | A | A | A | B |

As seen from Table 1, when the cavity content is not less than 40 cc/100 g, the recording materials have good picture quality as well as good opacity. As seen from Table 2, when a core layer is laminated, stiffness is improved.

As described hereinabove, the heat-sensitive recording material of the present invention has excellent resolution and it is possible to obtain a clear recorded image having a high density even with low printing energy.

What is claimed is:

1. A heat-sensitive recording material which comprises a substrate and a heat-sensitive recording layer formed thereon, said substrate having as a constituent element a synthetic resin film layer containing minute cavities, said synthetic resin film layer being biaxially oriented and comprising a mixture of a polyolefin or a polyester and a particulate substance immiscible with the polyolefin or polyester, wherein a content of cavities in said synthetic resin film layer is 40 to 100 cc/g.

2. A heat-sensitive recording material according to claim 1, wherein the substance immiscible with the polyolefin is an inorganic substance and the amount thereof is 5 to 50% by weight based on the total amount of the inorganic substance and the polyolefin.

3. A heat-sensitive recording material according to claim 1, wherein the substrate comprises the synthetic resin film layer laminated with a second film layer made of a material which is the same as or different from that of the synthetic resin film layer, said second film layer being laminated on a surface of the synthetic resin film layer opposite to the heat-sensitive recording layer.

4. A heat-sensitive recording material according to claim 3, wherein said second film layer comprises a layer of a synthetic resin film containing no cavities.

5. A heat-sensitive recording material according to claim 4, further comprising another layer of the synthetic resin film containing minute cavities laminated on the surface of said layer of a synthetic resin containing no cavities opposite to said heat-sensitive recording layer.

* * * * *

UNITED STATES PATENT AND TRADEMARK OFFICE
CERTIFICATE OF CORRECTION

PATENT NO. : 4,996,182

DATED : February 26, 1991

INVENTOR(S) : Takeshi MATSUI et al.

It is certified that error appears in the above-identified patent and that said Letters Patent is hereby corrected as shown below:

On the cover page of the patent, under the heading entitled "Assignee:", insert the following after "Osaka, Japan":

-- and Kanzaki Paper Mfg. Co., Ltd.
Tokyo, Japan --

Signed and Sealed this

Fifteenth Day of September, 1992

*Attest:*

DOUGLAS B. COMER

*Attesting Officer*

*Acting Commissioner of Patents and Trademarks*